US007255247B2

(12) United States Patent
Aylward

(10) Patent No.: US 7,255,247 B2
(45) Date of Patent: Aug. 14, 2007

(54) APPARATUS AND METHODS FOR HANDLING PILLS

(75) Inventor: John Thomas Aylward, New Bern, NC (US)

(73) Assignee: Aylward Enterprises, Inc., New Bern, NC (US)

( * ) Notice: Subject to any disclaimer, the term of this patent is extended or adjusted under 35 U.S.C. 154(b) by 305 days.

(21) Appl. No.: 11/001,751

(22) Filed: Dec. 2, 2004

(65) Prior Publication Data

US 2006/0180234 A1 Aug. 17, 2006

(51) Int. Cl.
*B23Q 7/12* (2006.01)

(52) U.S. Cl. ..... 221/168; 221/277; 221/254

(58) Field of Classification Search ..... 221/160, 221/167, 168

See application file for complete search history.

(56) References Cited

U.S. PATENT DOCUMENTS

| | | | | |
|---|---|---|---|---|
| 2,509,069 | A | | 5/1950 | Mrachek |
| 2,656,962 | A | | 10/1953 | Daniels |
| 2,859,689 | A | | 11/1958 | Ackley |
| 3,417,542 | A | | 12/1968 | Merrill et al. |
| 4,018,358 | A | | 4/1977 | Johnson et al. |
| 4,094,439 | A | | 6/1978 | List |
| 4,353,456 | A | * | 10/1982 | Yamamoto ..... 198/397.04 |
| 4,697,721 | A | | 10/1987 | Johnson et al. |
| 5,577,286 | A | * | 11/1996 | Smith et al. ..... 56/328.1 |
| 5,806,686 | A | | 9/1998 | Ecker |
| 5,873,150 | A | | 2/1999 | Gerard |
| 5,884,806 | A | | 3/1999 | Boyer et al. |
| 5,996,768 | A | * | 12/1999 | Boyce et al. ..... 198/397.01 |
| 6,003,186 | A | * | 12/1999 | Larson ..... 15/82 |
| 6,185,901 | B1 | | 2/2001 | Aylward |
| 6,681,550 | B1 | | 1/2004 | Aylward |
| 6,799,413 | B2 | | 10/2004 | Aylward |
| 7,125,188 | B2 | * | 10/2006 | Gueret ..... 401/129 |
| 2004/0011806 | A1 | | 1/2004 | Luciano et al. |

* cited by examiner

*Primary Examiner*—Gene O. Crawford
*Assistant Examiner*—Timothy Waggoner
(74) *Attorney, Agent, or Firm*—Alston & Bird LLP

(57) ABSTRACT

A brush for a pill handling apparatus and an associated pill handling apparatus and method are provided. The brush defines a non-circular profile and agitates the pills when rotated. For example, the brush can be rotatably mounted proximate a rotary slat of the pill handling apparatus so that the brush is configured to seat the pills into the receptacles of the apparatus, such as into receptacles defined by one or more rotary slats. Multiple brushes can be provided in a single pill handling apparatus, e.g., to define therebetween a reservoir for holding the pills.

31 Claims, 3 Drawing Sheets

APPARATUS AND METHODS FOR HANDLING PILLS

BACKGROUND OF THE INVENTION

1) Field of the Invention

The present invention relates to pill handling machines and, more particularly, relates to an apparatus and an associated method for handling pills with one or more brushes for controlling the movement of the pills.

2) Description of Related Art

Pharmaceutical medicines and associated packaging apparatuses are typically subject to relatively strict consumer protection guidelines. For example, pills, capsules, and the like, must be produced and packaged in such a way as to at least meet the minimum sterility requirements mandated by federal regulations. In addition, the pills should be delivered into the packaging such that the contents accurately meet the claimed labeling "count", i.e., so that each package includes exactly a predetermined number of pills. Notwithstanding the above, it is also desired to package the product in an automated operation to offset costs and provide an economic product.

In the past, pill filling machines have been proposed that provide automated bottle counts by filling a hopper with pills and causing a plurality of the pills to be caught by a pill capturing device, such as an array of rotary slats. The rotary slats drop the captured pills into a plurality of bottles disposed in alignment with the dropping pills. The bottles are distributed along an endless conveyor belt that is timed to advance and stop the bottles according to the filling operation.

Conventional pill capturing devices more particularly include a series of rotary slats each configured to receive, hold, and move a plurality of capsules or pills along a closed path. Each rotary slat is typically a disc-like device that is fixed on a rotatable shaft and has a plurality of openings in the outer peripheral edge portion thereof for capturing individual pills. Accordingly, the closed path is arcuate and generally disposed between the pill hopper and a discharge area above the conveyor belt. By the rotary action of the slats, the pills move in a direction normal to the conveyor belt. The pill capturing device then generally discharges the pills by rotating the slats, which move corresponding to the closed path, such that the pills fall out of the respective openings at the filling station. The pills are often funneled through a chute that empties into a corresponding bottle.

The "count," or number of pills in the bottle, can be determined by positioning the bottles in the pill dropping zone for a predetermined time. The duration of the filling operation for each bottle corresponds to the number of openings in each slat that the machine is capable of delivering to the bottles per unit of time. The duration of the filling operation, speed of the rotary slats, and configuration of the pill capturing device are used to calculate the count.

U.S. Pat. No. 6,185,901 to Aylward, titled "Positive Count Rotary Slat Packaging Apparatus and Related Methods," provides an improved machine with independently driven rotary slats. The pills are allowed to fall from a reservoir into an exterior receptacle of a rotary slat and, a separate counting device is associated with each rotary slat for counting each pill as it falls from the slat into the container. A positive count is provided for each container, and improperly filled slats will not affect the total count for that container. That is, if a particular container has a low count, the respective slat can be further rotated to fill the container. Because the slats are independently driven, the other slats can remain stationary to prevent overfilling. Thus, the machine permits an accurate filling of each bottle.

Although the slats can be independently driven to achieve a desired count in each container, it is typically desirable to dispense pills from most or all of the receptacles to minimize the rotation necessary for filling the container and thereby minimize the time required for filling the container. In this regard, FIGS. 1 and 3 of U.S. Pat. No. 6,185,901 illustrate a cylindrical brush 24 that rotates in the same direction as the slats 15 so that the bottom surface of the brush rotates against the direction of the surface of the slats. This round brush works to help seat the captured pills 11 into the opening 18 and also to divert additional pills from the delivery path. This device has proven to operate very well; however, occasionally pills may fail to fall into the openings or may become jammed in or fall through the area 13 where the bottom of the reservoir 12 meets the rotating slats.

Accordingly, there exists a need for an improved pill handling device that facilitates the delivery of pills into receptacles. The handling device should reduce or minimize the occurrence of jamming of the pills and increase or maximize the placement of the pills in the receptacles to thereby increase the efficacy of the device.

BRIEF SUMMARY OF THE INVENTION

The present invention provides a brush for agitating pills in a pill handling apparatus and an associated pill handling apparatus and method therefor. The brush is configured to seat the pills into the receptacles of the apparatus, such as into receptacles defined by one or more rotary slats. Thus, the brush can increase the placement of the pills in the receptacles and potentially increase the productivity of the device.

According to one embodiment of the present invention, the brush includes a support member that extends in a longitudinal direction and a plurality of bristles connected thereto. The ends of the bristles extend generally radially outward from the support member to dissimilar radially outward positions. Thus, the brush defines a substantially continuous and non-circular profile that can agitate the pills when rotated. For example, the brush can be rotated against a surface of the pill handling apparatus that defines the receptacles and can seal against the surface to prevent passage therebetween of pills outside the receptacles. The profile of the brush, which can be polygonal, can be substantially the same along a direction of a rotational axis of the brush. In some cases, the orientation of the profile of the brush is nonuniform along the length of the brush.

The present invention also provides a pill handling apparatus that includes a rotary slat having an outer surface defining a plurality of receptacles and at least one brush. The brush is rotatably mounted proximate the slat to agitate the pills as the brush rotates. One or more combs can also be provided, each comb having a plurality of elongate members that extend toward the bristles of the brush to retain pills rotated by the bristles. According to one aspect of the invention, the apparatus includes two of the brushes that define a reservoir therebetween for receiving and holding the pills. The brushes can be configured to rotate in opposite directions so that a portion of each brush that is in contact with the slat is rotated toward the reservoir.

One method of handling pills according to the present invention includes rotating a rotary slat defining a plurality of receptacles so that pills are rotatably transported by the slat, and rotating at least one brush proximate the slat to thereby move a plurality of bristles of the brush proximate the slat. The bristles extending generally radially outward to dissimilar radially outward positions to define a substantially continuous and non-circular profile so that the brush agitates the pills as the brush rotates. A seal between the slat and the brush can be maintained as the brush rotates so that pills disposed outside the receptacles are prevented by the brush from passing between the brush and the slat. The brushes can also circulate the pills in the reservoir in a direction generally parallel to a rotational axis of the brush. Further, the brush can be combed with a plurality of elongate members to retain pills rotated by the bristles.

In one embodiment, two brushes can be provided proximate the slat to define a reservoir for holding a plurality of pills. The rotary slats rotate so that pills are transported by receptacles defined by the slat. The brushes are also rotated to agitate the pills in the reservoir. For example, the brushes can be rotated in opposite directions so that a portion of each brush that is in contact with the slat is rotated toward the reservoir. According to one aspect of the invention, each brush also circulates the pills in a direction parallel to a rotational axis of the brush.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The present invention is generally directed to a pill handling apparatus 10, such as an automated packaging machine. For example, the handling apparatus of the present invention can be used for dispensing pills into containers, as is further discussed in U.S. Pat. No. 6,185,901 to Aylward, the entire contents of which is incorporated herein by reference. In other embodiments of the present invention, the pill handling apparatus can be used for other handling operations besides pill packaging, such as transporting pills during manufacture or inspection or the like.

Figure 1:
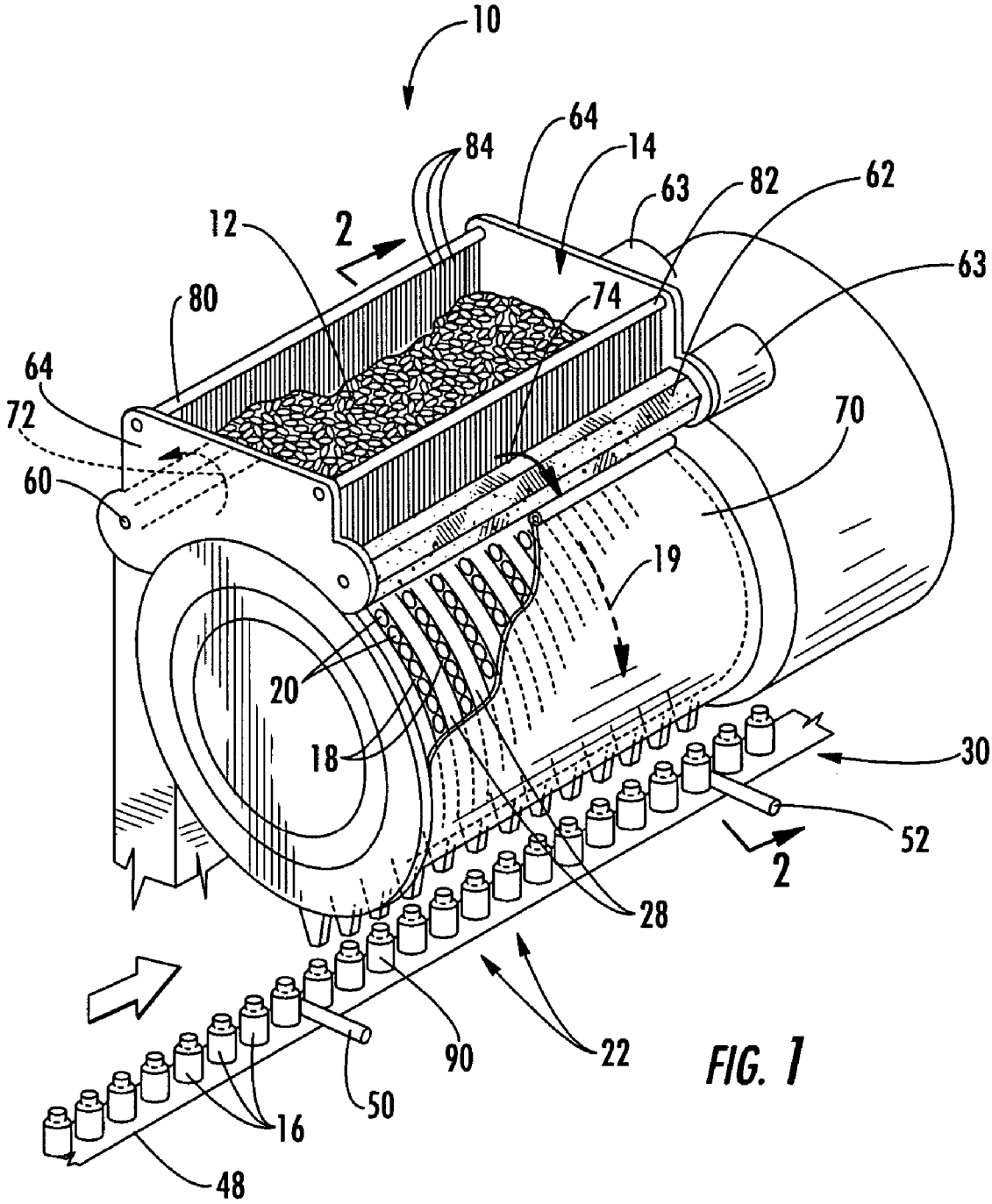
FIG. 1 is a perspective view illustrating a pill handling apparatus according to one embodiment of the present invention.

As illustrated in FIG. 1, the pill handling apparatus 10 is adapted for delivering pills 12 from a reservoir 14 into containers 16. As used herein, the term "pill" is not intended to be limiting and includes any discrete articles of the type used in the pharmaceutical industry or otherwise including, but not limited to, capsules, caplets, gelcaps, dragees, and tablets. Similarly, the receiving containers 16, although illustrated as a bottles throughout, are not limited thereto and can be any of various configurations which provide an opening for receiving discrete articles therein, such as pouches or boxes.

The pill handling apparatus 10 includes one or more rotary slats 18 for transporting the pills 12 in receptacles 20 defined at the periphery of each slat 18. The slats 18 can be independently mounted so that each slat 18 can be rotated to transport the pills 12 independent of the other slats 18. For example, the slats 18 can be mounted on a support shaft 26 (FIG. 2) with stationary spacers 28 provided therebetween. In some cases, the slats 18 can be individually removeable, e.g., for repair or replacement or to adjust the number of slats 18 for operation in the apparatus 10. Each of the rotary slats 18 can correspond to a filling station 22 that also includes a counting device 24 (FIG. 2) and an aligned container 16. Thus, the slats 18 can independently dispense the pills 12 from the reservoir 14 to the respective containers 16 at the filling stations 22.

Figure 2:
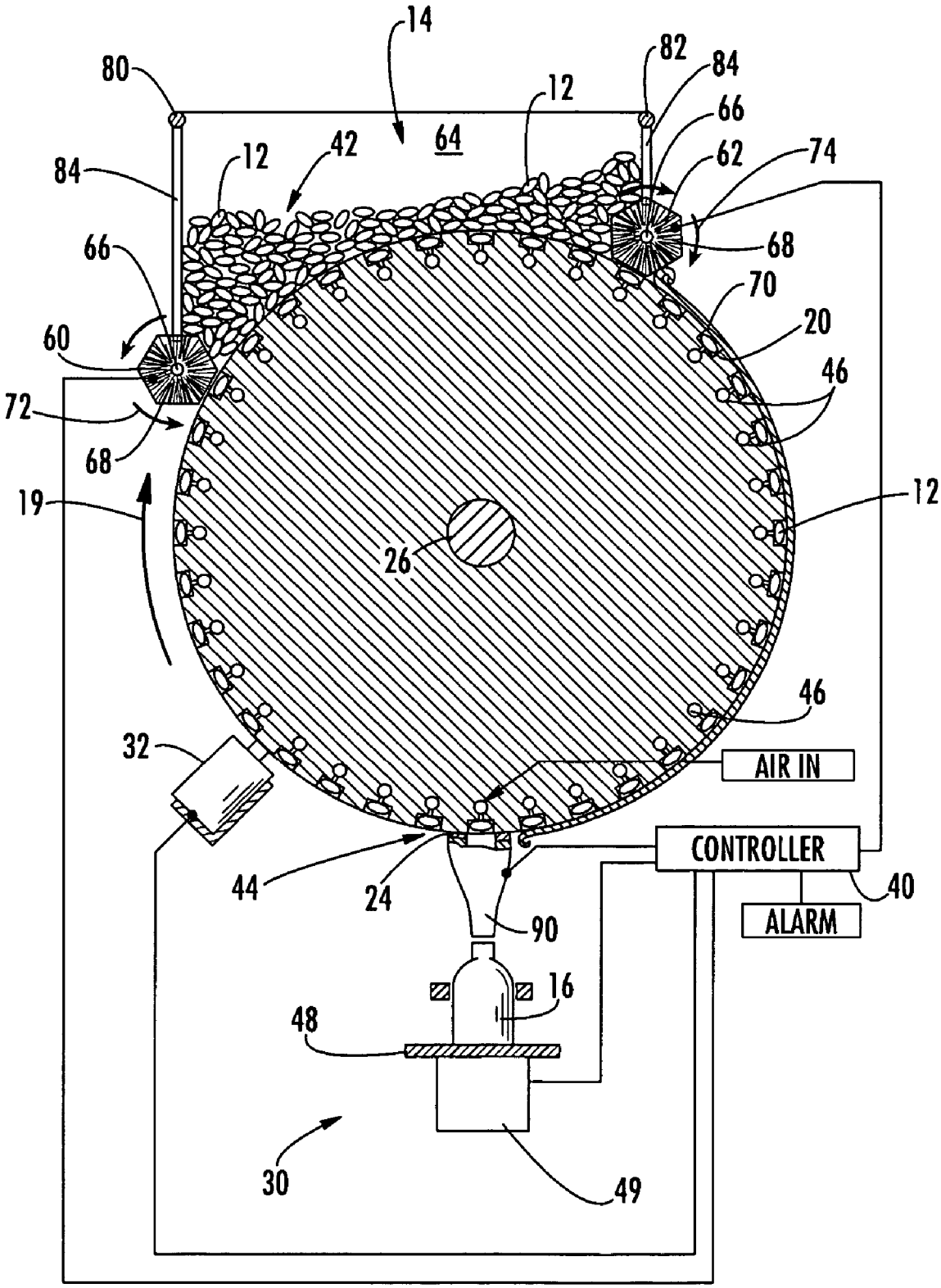
FIG. 2 is a section view illustrating the apparatus of FIG. 1, as seen along line 2-2 of FIG. 1.

The construction and operation of the pill handling apparatus 10 can be similar to the device described in U.S. Pat. No. 6,185,901. In particular, as indicated in FIG. 2, each of the rotary slats 18 can be operably connected to, and driven by, a separate drive device such as a drive motor 32 that is connected to the respective slat 18 via one or more belts, pulleys, drive shafts, frustoconically-shaped drive wheels, or the like. A controller 40 can be provided for controlling the operation of the drive motor(s) 32, and the controller 40 can also operate the slats 18 at various speeds. For example, each slat 18 can be operated at a fast speed during the initial portion of the pill filling operation until a predetermined number of the pills 12 are delivered to the respective container 16 and then at a slow speed to finish the filling operation and prevent underfill or overfill of the container 16.

As illustrated in FIG. 2, each rotary slat 18 rotates in a clockwise direction 19 defining an arcuate delivery path from a first, pill capture position 42 within the reservoir 14 to a second, release position 44, generally about 180-270 degrees away from the first position 42, where the pill 12 is released. The rotary slats 18 can also include air passages 46 in fluid communication with the pill receptacles 20 so that pressurized air can be directed toward the pill 12 when the pill 12 is at the release position 44 to assist in the ejection of the pill 12 from the receptacle 20 at the predetermined release point 44.

A number of transportation devices that are known in the art can be used to transport the containers 16 to and away from the filling stations 22. For example, the containers 16 can be supported by a conveyor belt 48 that is driven by a motor 49 in a direction parallel to the axis of rotation of the rotary slats 18. A first stop gate 50 is positioned proximate to the conveyor belt 48 and configured to be extended to block the path of the containers 16 on the conveyor belt 48 and hold the containers 16 in positions corresponding to the filling stations 22. Similarly, a second stop gate 52 can be extended to block the path of the unfilled containers 16 before they have entered the filling stations 22. Alternatively, a screw auger (not shown) can be used to transport the containers 16 and position the containers 16 at the filling stations 22. The screw auger maintains the containers 16 at consecutively spaced intervals, and as the screw auger is rotated, each of the containers 16 is transported toward or away from the filling stations 22. Thus, the rotational speed of the screw auger can be adjusted to speed, slow, stop, or reverse the direction of the containers 16. In any case, the operation of the transportation device can be controlled by the controller 40.

The controller 40 can also control the speed of the drive motors 32 so that, for example, each rotary slat 18 can be slowed down before the corresponding container 16 is filled to prevent overfilling. Additionally, the controller 40 can alternately accelerate and decelerate the rotary slats, individually or in unison, to cause a jerking or vibratory motion in the rotary slats 18 and agitate the pills 12. Such agitation of the pills 12 can be useful in encouraging the pills 12 to become seated in the pill receptacles 20. After the containers 16 at the filling stations 22 have been filled, the containers 16 are transported away from the filling stations 22 for further processing or packaging and different, unfilled containers 16 are transported to the filling stations 22.

As shown in FIG. 2, the handling apparatus 10 includes first and second brushes 60, 62 (or "brush bars") that are rotatably mounted proximate the rotary slats 18. The second brush 62 can facilitate the receipt of the pills 12 in the receptacles 20 by seating the pills 12 in the respective receptacles 20 as the pills 12 pass between the brush 62 and the slats 18 and/or by diverting additional pills 12 away from the delivery path. For example, if one of the pills 12 is partially disposed in one of the receptacles 20 but not fully seated in the receptacle 20, the brush 62 can reorient the pill 12 and/or push the pill 12 into the receptacle 20. However, each of the brushes 60, 62 is typically configured so that pills 12 disposed outside the receptacles 20 cannot pass between the brush 60, 62 and the slats 18. That is, if a pill 12 is not at least partially disposed in one of the receptacles 20, the pill 12 is prevented from passing between the slats 18 and the brushes 60, 62 and instead urged into the reservoir 14.

As shown in FIG. 1, the two brushes 60, 62 can define the reservoir 14 therebetween for receiving and holding the pills 12. That is, the brushes 60, 62 can be rotatably mounted proximate the periphery of the slats 18, with the brushes 60, 62 defining therebetween a circumferential portion of the periphery of the slats 18. Typically, the brushes 60, 62 are positioned proximate the upper portion of the slats 18 with the rotational axis of each brush 60, 62 extending in a direction generally parallel to the rotational axis of the slats 18. Side plates 64 can also be provided between the brushes 60, 62 to further define the reservoir 14. Thus, the slats 18, the brushes 60, 62, and the side plates 64 can, in combination, comprise the reservoir 14, i.e., a hopper in which the pills 12 can be disposed and held.

The pills 12 in the reservoir 14 can be individually received in the receptacles 20 and transported out of the reservoir 20 for dispensing into the containers 16. For example, FIG. 2 illustrates a plurality of the pills 12 held in the reservoir 14 to be dispensed therefrom. In this regard, each slat 18 is configured to be rotated in direction 19. Each receptacle 20 of the slat 18 is rotated under the first brush 60 and into the reservoir 14, where a pill 12 can be received in each receptacle 20. Each receptacle 20 then passes under the second brush 62 and out of the reservoir 14. If the pill 12 is not fully seated in the receptacle 20, the second brush 62 can reorient the pill 12 so that the pill 12 is properly seated, or the brush 62 can divert the pill 12 back into the reservoir 14 to prevent the pill 12 from exiting the reservoir 14. Thus, the pills 12 typically exit the reservoir 14 only in the receptacles 20. In other words, pills 12 that are not disposed in the receptacles 20 do not typically pass between the slats 18 and the brushes 60, 62 to exit the reservoir 14. It is appreciated that some of the receptacles 20 may pass through the reservoir 14 without receiving a pill 12.

A cover 70 can be positioned adjacent the second brush 62 to assist in maintaining the pills 12 in the receptacles 20 during travel to the filling stations 22. The cover 70 can also facilitate cleanliness by preventing environmental debris from entering the delivery path or contacting the pills 12 in the receptacles 20. For example, the cover 70 can be a flexible thin material such as a Teflon® blanket, registered trademark of E. I. du Pont de Nemours and Company.

Each of the brushes 60, 62 is typically rotated during operation, e.g., by motors 63. In particular, the first brush 60 can be rotated in a rotational direction 72 opposite the rotational direction 19 of the slats 18, and the second brush 62 can be rotated in a rotational direction 74 that is the same as the slats 18. That is, a portion of the first brush 60 in contact with the slats 18 can be moved in a tangential direction that is the same as the tangential direction of the slats 18 at the first brush 60, and a portion of the second brush 62 in contact with the slats 18 can be moved in a tangential direction that is opposite to the tangential direction of the slats 18 at the second brush 62. Such rotation of the brushes 60, 62 can facilitate the sealing of the reservoir 14, i.e., by preventing the pills 12 outside the receptacles 20 from passing between the brushes 60, 62 and the slats 18.

Figure 3:
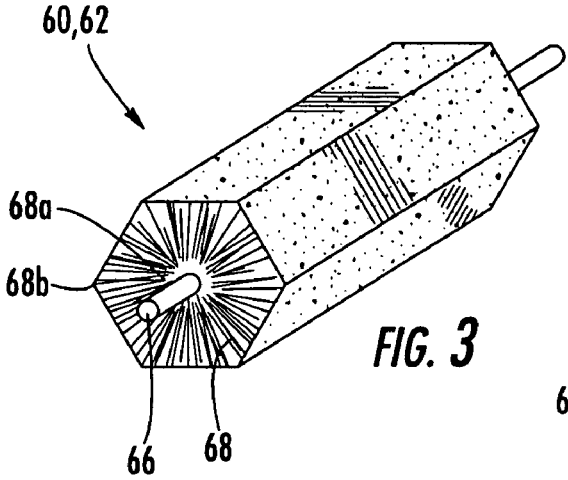
FIG. 3 is a perspective view illustrating one of the brushes of the apparatus of FIG. 1.

The rotation of the brushes 60, 62 can also agitate the pills 12 in the reservoir 14. That is, the brushes 60, 62 can vibrate the pills 12, circulate the pills 12 throughout the reservoir 14, or otherwise impart motion to the pills 12 to thereby increase the likelihood of the pills 12 being received in the receptacles 20 and/or decrease the likelihood of the pills 12 jamming in the reservoir 14. As shown in FIG. 3, each brush 60, 62 typically includes a support member 66 that defines a rotational axis of the respective brush 60, 62 and a plurality of bristles 68 extending generally radially outward from the support member 66. That is, a first end 68*a* of each bristle 68 can be connected to the support member 66 so that a second distal end 68*b* of the bristle 68 extends radially outward therefrom. It is appreciated, however, that the bristles 68 can be supported in other configurations, e.g., by a support device 66 that engages each bristle 68 at a point between the ends 68*a*, 68*b* of the bristle 68. The non-circular profile of the brushes 60, 62, as defined by the second ends 68*b* of the bristles 68, can enhance the agitation of the pills 12 by the brushes 60, 62. In some cases, a separate vibrator can also be provided to assist in the insertion of the pills 12 into the rotary slats 18.

Figure 4A:
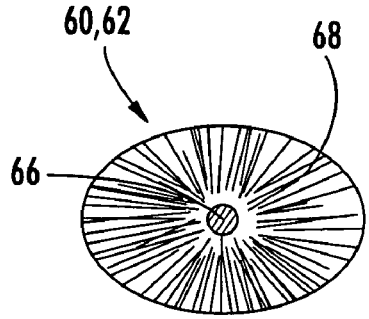
FIGS. 4A-4E are section views illustrating brushes defining various profiles according to other embodiments of the present invention.
Figure 4B:
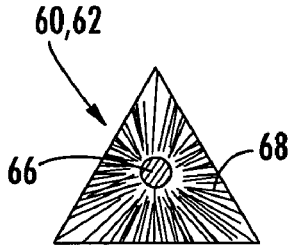
Figure 4C:
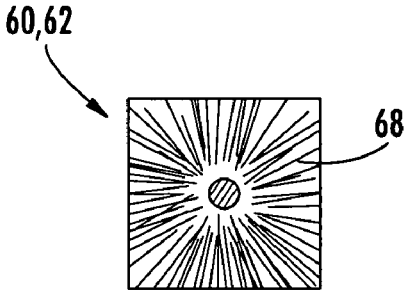
Figure 4D:
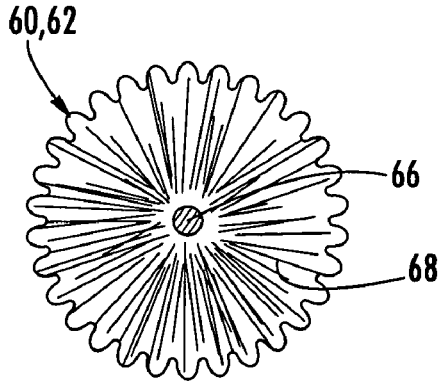
Figure 4E:
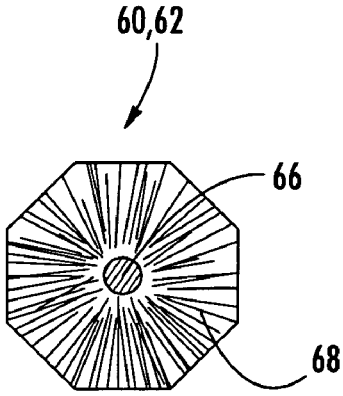

The bristles 68 can extend in the radial direction of the brush 60, 62 or at an angle relative to the radial direction. In either case, the second ends 68*b* of the bristles 68 define a profile of each brush 60, 62. If multiple brushes 60, 62 are provided in the apparatus 10, the profile of the brushes 60, 62 can be the same or different. In some cases, one or more of the brushes 60, 62 can have a circular profile and another one or more brush 60, 62 can have a non-circular profile. The profile of each brush 60, 62 can define any of various non-circular shapes. For example, each brush 60, 62 can have a hexagonal profile, as shown in FIGS. 1-3. Alternatively, one or both brushes 60, 62 can have a profile that is elliptical (FIG. 4A), triangular (FIG. 4B), rectangular (FIG. 4C), irregular (FIG. 4D), octagonal (FIG. 4E), or otherwise non-circular. The bristles 68 are typically closely spaced so that the profile of the brush 60, 62, as defined by the second ends 68*b* of the bristles 68, is substantially continuous, e.g., to define a polygonal profile.

In some cases, the brushes 60, 62 are mounted sufficiently close to the slats 18 so that each brush 60, 62 maintains continuous contact with the slats 18 as the brushes 60, 62 rotate. That is, each brush 60, 62 can be positioned close enough to the slats 18 so that the second ends 68*b* of some of the bristles 68 are always in contact with the slats 18. All or some of the bristles 68, such as those bristles that extend to relatively greater radially outward distances relative to the other bristles, may be bent against the slats 18 when directed toward the slat 18. Alternatively, a small space may be defined between each brush 60, 62 and the slats 18 at least temporarily during rotation of the brushes 60, 62, e.g., when those bristles that extend to relatively less radially outward distances are directed toward the slats 18. If a space is defined between the slats 18 and either brush 60, 62 at any time during operation, the space is typically smaller than the smallest dimension of the pills 12 so that the pills 12 that are not disposed in the receptacles 20 cannot pass between the brushes 60, 62 and the slats 18.

Figure 5:
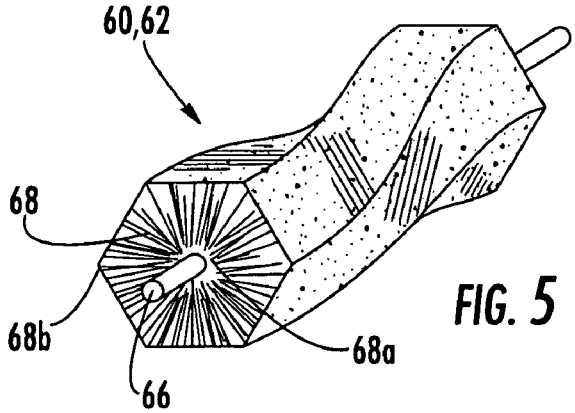
FIG. 5 is a perspective view illustrating a brush having a profile with a nonuniform orientation along the length of the brush.

While the profile of each brush 60, 62 illustrated in FIGS. 1-3 is uniform along the longitudinal length of the brush 60, 62, it is appreciated that the brushes 60, 62 can define various other profile patterns. For example, either brush 60, 62 can have a hexagonal (or otherwise polygonal) profile with a "twisted" or "spiral" configuration along the length of the brush 60, 62, as illustrated in FIG. 5. That is, the brush 60, 62 of FIG. 5 defines the same profile along the length of the brush 60, 62; however, the orientation of the profile is nonuniform along the axis of the brush 60, 62. In other words, the brush 60, 62 defines a hexagonal profile at all locations along the length of the brush 60, 62, but the hexagonal profile has different rotational orientations along the length. The uniformity and configuration of the profile of the brush 60, 62 can affect the agitation of the pills 12 in the reservoir 14. In particular, a twisted configuration such as the one illustrated in FIG. 5 can result in a circulation of the pills 12 in a direction generally parallel to the longitudinal axis of the brush 60, 62. Thus, as the brush 60, 62 rotates, the pills 12 in the reservoir 14 proximate the brush 60, 62 can be moved along the length of the brush 60, 62, potentially reducing the tendency of the pills 12 to bridge or otherwise jam proximate the brush 60, 62 and increasing the uniform distribution of the pills 12 in the reservoir 14. In some cases, the brushes 60, 62 can circulate the pills 12 in opposite directions so that the pills 12 therebetween tend to circulate in a generally swirling motion in the reservoir 14.

Combs 80, 82 can be provided for clearing any pills 12 that become stuck in the bristles 68 of the brushes 60, 62. As shown in FIGS. 1 and 2, each comb 80, 82 includes elongate members 84 that extend toward and between the bristles 68 of the brush 60, 62. Combs 80, 82 can be stationary devices, e.g., mounted above the brushes 60, 62 as illustrated, and can be formed of a relatively stiff material such as metal or plastic. The elongate members 84 are typically thin to avoid substantially interfering with the motion of the bristles 68, and sufficiently close together so that pills 12 cannot pass through the combs 80, 82. Thus, as the brushes 60, 62 rotate, the combs 80, 82 retain any of the pills 12 that are carried by the bristles 68 to the position of the elongate members 84. The pills 12 can then fall back into the reservoir 14. In this way, the combs 80, 82 can prevent the brushes 60, 62 from rotating the pills 12 out of the reservoir 14.

In a typical operation of the pill handling apparatus 10, the containers 16 are advanced to the respective filling stations 22 and stopped. Once properly positioned at the filling stations 22, the rotary slats 18 can be rotated at the same time and speed to begin the filling operation and slowed at the same time to a slower fill rate at a count close to the desired full count. Because the rotary slats 18 are all rotated concurrently the slats 18 should fill the containers 16 at substantially the same rate, increasing throughput for the filling operation. At the end of the filling operation, the controller 40 directs the filled containers 16 out of the filling stations 22 and directs unfilled containers 16 to the filling stations 22. However, if any one container 16 is determined to be underfilled, i.e., with less than a desired number of the pills 12, the controller 40 will not advance the containers 16 (or at least that container) and instead directs the individual rotary slat 18 at the underfilled station to rotate forward, thereby advancing an increased number of released pills 12 to fill the underfilled container 16. The controller 40 then will release the containers 16 and cause the conveyor to advance the containers 16 out of the filling stations 22.

The number of pills 12 delivered to each container 16 can be determined and used to direct the independent operation of the rotary slats 18. In this regard, one of the counting devices 24 of the apparatus 10 can be associated with each filling station 22. Each counting device 24 can be sized and configured to extend between the rotary slat 18 and the opening in the container 16. Further, the device 24 can be positioned substantially adjacent the opening in a chute 90 above the container 16 so that any pill 12 which travels through the device 24 will enter the container 16 without falling outside the delivery path. It will be appreciated that the chute 90 is not always necessary and may be omitted if the tops of the containers 16 are sufficiently close to the rotary slats 18. In some cases, the chutes 90 can direct pills 12 from multiple rotary slats 18 into a single container 16 to provide more rapid filling. One exemplary counting device 24 includes an infrared light source and a light receiver positioned substantially opposite the light source across a central passage of the device 24. The light source generates a light beam that is detected by the opposing light receiver. When the light beam is interrupted by a falling pill 12, the light receiver transmits a signal which increases the count in the controller 40. Thus, the number of interruptions corresponds to the number of pills 12 which have been delivered into the container 16.

In some cases, the controller 40 can also control the quantity of pills 12 provided in the reservoir 14. In this regard, a level sensor can detect the quantity of pills 12 in the reservoir 14, e.g., optically, by weight, or otherwise. The level sensor communicates a corresponding value or signal to the controller 40. When the controller 40 detects that the level of pills 12 in the reservoir 14 is below the desired level, the controller 40 can open a reservoir gate that controls the passage of pills 12 from a bin to the reservoir 14, thereby maintaining a desired number of pills 12 in the reservoir 14. The desired level of pills 12 in the reservoir 14 can be adjusted to optimize the seating of pills 12 in the receptacles 20 of the slats 18 and to prevent wearing or breaking of the pills 12 caused by overfilling of the reservoir 14.

The rotary slats 18 of the pill handling apparatus 10 can have a variety of configurations. For example, as illustrated in FIGS. 1 and 2, each rotary slat 18 of the pill handling apparatus 10 is configured to receive the pills 12 on an outer surface. That is, the receptacles 20 on each slat 18 extend partially inward from the outer surface of the wall of the slat 18 so that the pills 12 can be at least partially received into the receptacles 20 but do not pass entirely through the receptacles 20. In other embodiments of the present invention, the pills 12 can instead be received from the interior of the slats and/or can pass entirely through the receptacles. For example, the reservoir for the pills 12 can be defined within the slats, and the receptacles can deliver the pills 12 from the interior of the slats to the exterior thereof. Such a configuration is described in U.S. Pat. No. 6,681,550 to Aylward, titled "Apparatus and Methods for Filling Containers with Pills," issued Jan. 27, 2004 and U.S. patent application Ser. No. 10/717,994 to Aylward, with the same title, filed Nov. 20, 2003, the entire contents of both of which are incorporated herein by reference. It is appreciated that the brushes 60, 62 of the present invention can be positioned within the interior of the slats and configured to agitate the pills 12 to facilitate the entry of the pills 12 into the receptacles. Further, in other embodiments of the present invention, the brushes 60, 62 can be used in other configurations, e.g., with a handling apparatus having a single rotary slat defining one or more rows of receptacles thereon, with a handling apparatus having receptacles that are slot-like or otherwise configured to receive multiple pills, and the like.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A pill handling apparatus comprising:

a rotary slat having an outer surface defining a plurality of receptacles; and at least one brush rotatably mounted proximate the slat, the brush having a plurality of bristles, each bristle extending generally radially outward between a first end and a second end, the bristles extending to dissimilar radially outward positions such that the second ends of the bristles define a substantially continuous and non-circular profile of the brush and the brush is configured to agitate the pills as the brush rotates.

2. An apparatus according to claim 1 wherein the brush comprises a support member extending in an axial direction of the brush, the first ends of the bristles being connected to the support member and the second ends extending outward therefrom.

3. An apparatus according to claim 1 wherein the apparatus comprises two of the brushes, the brushes being mounted proximate the slat and defining a reservoir therebetween for receiving and holding the pills.

4. An apparatus according to claim 1 wherein the profile of the brush defines a polygon.

5. An apparatus according to claim 1 wherein the brush is adapted for sealing against the rotary slat as the brush rotates to prevent passage of pills disposed outside the receptacles of the slat between the brush and the slat.

6. An apparatus according to claim 1 wherein the profile of the brush is substantially the same along a direction parallel to a rotational axis of the brush.

7. An apparatus according to claim 1 wherein an orientation of the profile of the brush is nonuniform along a direction parallel to a rotational axis of the brush.

8. An apparatus according to claim 1, further comprising a comb defining a plurality of elongate members extending toward the bristles of the brush and configured to retain pills rotated by the bristles.

9. A pill handling apparatus comprising:

at least one rotary slat having an outer surface defining a plurality of receptacles; and first and second brushes rotatably mounted proximate the rotary slat and thereby defining a reservoir between the brushes, each brush being configured to prevent pills disposed outside the receptacles from passing between the brush and the slat, wherein each brush defines a non-circular profile such that rotation of each brush agitates the pills in the reservoir.

10. An apparatus according to claim 9 wherein the first and second brushes are configured to rotate in opposite directions, such that a portion of each brush in contact with the slat is rotated toward the reservoir.

11. An apparatus according to claim 9 wherein each brush comprises a plurality of bristles extending generally radially outward to define the non-circular profile.

12. An apparatus according to claim 9 wherein the profile of each brush defines a polygon.

13. An apparatus according to claim 9 wherein the profile of the brush is substantially the same along a direction parallel to a rotational axis of the brush.

14. An apparatus according to claim 9 wherein an orientation of the profile of the brush is nonuniform along a direction parallel to a rotational axis of the brush.

15. An apparatus according to claim 9, further comprising at least one comb defining a plurality of elongate members extending toward the bristles of one of the brushes and configured to retain pills rotated by the bristles.

16. A pill handling apparatus comprising:

a rotary slat having an outer surface and defining a plurality of receptacles; and a brush having a support member extending in a longitudinal direction of the rotary slat and a plurality of bristles connected to the support member, each bristle defining an end extending generally radially outward from the support member, the ends of the bristles extending to dissimilar radially outward positions to define a substantially continuous and non-circular profile of the brush such that the brush is adapted to agitate the pills as the brush rotates.

17. An apparatus according to claim 16 wherein the profile of the brush defines a polygon.

18. An apparatus according to claim 16 wherein the brush is adapted for sealing against a surface of the pill handing apparatus defining the receptacles as the brush rotates to prevent passage of pills disposed outside the receptacles between the brush and the surface.

19. An apparatus according to claim 16 wherein the profile of the brush is substantially the seine along a direction parallel to a rotational axis of the brush.

20. An apparatus according to claim 16 wherein an orientation of the profile of the brush is nonuniform along a direction parallel to a rotational axis of the brush.

21. An apparatus according to claim 16, further comprising a comb defining a plurality of elongate members extending toward the bristles and configured to retain pills rotated by the bristles.

22. A method of handling pills, the method comprising:

rotating a rotary slat defining a plurality of receptacles such that pills disposed in the receptacles are rotatably transported by the slat; and rotating at least one brush proximate the slat to thereby move a plurality of bristles of the brush proximate the slat, the bristles extending generally radially outward to dissimilar radially outward positions such that the bristles define a substantially continuous and non-circular profile and the brush agitates the pills as the brush rotates.

23. A method according to claim 22 wherein said step of rotating the at least one brush comprises rotating a first brush and a second brush proximate the slat and holding a plurality of pills in a reservoir defined by the brushes.

24. A method according to claim 22 wherein said step of rotating the at least one brush comprises maintaining a seal between the slat and the brush as the brush rotates such that pills disposed outside the receptacles are prevented by the brush from passing between the brush and the slat.

25. A method according to claim 22 wherein said step of rotating the at least one brush comprises circulating the pills in a direction parallel to a rotational axis of the brush.

26. A method according to claim 22, further comprising combing the brush with a plurality of elongate members to retain pills rotated by the bristles.

27. A method of handling pills, the method comprising:

providing first and second brushes having non-circular profiles proximate at least one rotary slat such that the brushes define a reservoir therebetween;

rotating the rotary slat such that pills are rotatably transported by receptacles defined by the rotary slat; and rotating the brushes and thereby agitating pills in the reservoir, each brush preventing pills disposed outside the receptacles from passing between the brush and the slat.

28. A method according to claim 27 wherein said step of rotating the brushes comprises rotating the first and second brushes in opposite directions such that a portion of each brush in contact with the slat is rotated toward the reservoir.

29. A method according to claim 27 wherein said step of rotating the brushes comprises maintaining a seal between the slat and each brush as each brush rotates such that pills disposed outside the receptacles are prevented by the brushes from passing between the brushes and the slat.

30. A method according to claim 27 wherein said step of rotating the brushes comprises circulating the pills in a direction parallel to a rotational axis of the brush.

31. A method according to claim 27, further comprising combing the brush with a plurality of elongate members to retain pills rotated by the bristles.

* * * * *